US008166687B2

(12) United States Patent
Zhu

(10) Patent No.: US 8,166,687 B2
(45) Date of Patent: May 1, 2012

(54) ELECTRIC FIREPLACE WITH FLAME CURTAIN

(76) Inventor: Hongfeng Zhu, Zhejiang (CN)

( * ) Notice: Subject to any disclaimer, the term of this patent is extended or adjusted under 35 U.S.C. 154(b) by 129 days.

(21) Appl. No.: 12/388,026

(22) Filed: Feb. 18, 2009

(65) Prior Publication Data

US 2010/0205839 A1 Aug. 19, 2010

(51) Int. Cl.
*G09F 19/00* (2006.01)

(52) U.S. Cl. ..... 40/428; 219/218

(58) Field of Classification Search ..... 40/428; 392/348; 472/62

See application file for complete search history.

(56) References Cited

U.S. PATENT DOCUMENTS 1,336,500 A * 4/1920 Berry ..... 40/428
4,965,707 A * 10/1990 Butterfield ..... 362/96
6,944,982 B2 * 9/2005 Schroeter et al. ..... 40/428
2009/0251669 A1 * 10/2009 Power ..... 353/38
* cited by examiner

*Primary Examiner* — Casandra Davis
(74) *Attorney, Agent, or Firm* — Global IP Services; Tianhua Gu

(57) ABSTRACT

The invention relates to a An electric fireplace with a flame curtain comprises a housing, a light source, a flame curtain with integral structure being disposed on the electric fireplace and in front of an electric fireplace flame generator, an imaging mechanism and a charcoal bed being disposed on the flame curtain, and a number of light-holding charcoal with a plurality of transparent surfaces being disposed on the charcoal bed. The essential effect of the present invention is to solve the problems of constant charcoal flame brightness, the lacking of reality and the bad charcoal flame simulation effect in conventional electric fireplaces. Meanwhile, the problems of constant charcoal flame shape, dull appearance and poor visual effect in conventional electric fireplace are solved as well. The present invention is of simple structure and easy assembly process, while the charcoal flame structure can be arbitrarily changed, the light-spots of the flame are sparkling intermittently with bright and shade, and the flame is of light-holding effect. The visual effect and the authenticity are both perfect.

10 Claims, 5 Drawing Sheets

ELECTRIC FIREPLACE WITH FLAME CURTAIN

FIELD OF THE INVENTION

The present invention relates to an electric fireplace, more particularly, an electric fireplace with a flame curtain.

BACKGROUND OF THE INVENTION

Conventional fireplace simulator structures are divided into two types by the simulation of the burning substance of the fireplace. One is a simulation of burning flame by projecting varying light onto an image screen with imaging operation. Such as the flame simulator of electric fireplace disclosed in the patent with publication date Sep. 5, 2007 and publication number CN 200944291, comprises a light source, a flame board, a translucent image screen, a light shade with a transparent hole, a simulative fuel bed in front of a housing chamber. The light shade with a transparent hole is disposed at the back of the flame board, and a glass screen is fixed in front of the image screen. The light source cooperates with the light shade, and the light shade cooperates with a transmission mechanism. In the structure described above, the light shade can be disposed either horizontally or vertically to cooperate with the transmission mechanism to achieve a kind of axial and radial move of the light. The light forms the shape of flame after passing through a flame hole disposed on the flame board, and then be projected onto the image screen and the glass screen to carry out the visual effect of flame with vertical rising and horizontal waving. The other one is a simulation of burning charcoal flame in the fireplace by disposing an unchangeable structure with wood-like or charcoal-like figure besides or under the lower portion of the image screen. Such as the artificial wood for electric fireplace disclosed in the patent with publication date Apr. 7, 2004 and publication number CN 2610233, comprises an artificial wood base and a light source. The base is an irregular transparent chamber with artificial wood figure. LED tubes or light bulbs are disposed in the chamber. Each LED tubes or light bulbs are connected in series or in parallel and then lead out of the base by a conducting wire to connect with an external power source. The artificial wood base is of translucent material with pigment layers disposed irregularly on the external surface. The pigment layers can be chosen from various colors according to simulation needs, ordinarily, the dark brown similar to the wood color. The patent described above combines the artificial wood base and the light source. The light source is disposed in the artificial wood base. The base with pigment layer irregularly smeared on the external surface is made of transparent material. Thus, when the light source inside generates light, a kind of artificial burning effect with light and shade stager with each other is achieved, which is similar to the effect of burning charcoals. The structure is simple, realistic, and the figure and realism of which is closely to the natural burning flame. As to the charcoal flame simulated through the similar mode such as the wood or charcoal bed with fixed structure, the change between shade and light of the flame color achieves mainly via the pigment layers smeared irregularly on the external surface of the wood or the charcoal bed. Thus, the figure and the change between light and shade of the charcoal flame of each fireplace are constant and do not change. Thereby, the uniform external figure of the charcoal flame affects the visual effect. In addition, the brightness of the fireplace charcoal flame does not change either. The lack of intermittent light and shade of the spark light-spot and the realism make the simulation effect affected.

In addition, the image screen and the charcoal bed of a traditional fireplace are disposed separately; the installation structure should be mounted corresponding to the image screen and the charcoal bed, which is more complicated in structure and installation.

SUMMARY OF THE INVENTION

To solve the problems such as the constant brightness of charcoal flame, the lack of realism and bad simulation effect of charcoal flame and etc. . . . . The present invention provides an electric fireplace with a flame curtain. The main object of the present invention is to provide an electric fireplace with light-spots of the flames intermittent light and shade when the charcoals are burning, and nice realistic and simulation effect.

Another object of the present invention is to provide a electric fireplace with a flexible charcoal structure and a better visual effect, and solve the problems such as the figure of charcoal flame is fixed, the appearance is dull and the visual effect is poor and etc. . . . .

The third object of the present invention is to provide a electric fireplace with a simple structure and easy assembly, to solve problems such as the structure is complicated, the assembly is effort-cost and etc. . . . .

According to one exemplary embodiment, the present invention relates to an electric fireplace with a flame curtain comprising: a housing; a light source; a flame curtain with integral structure being disposed on the electric fireplace and in front of an electric fireplace flame generator; an imaging mechanism and a charcoal bed being disposed on the flame curtain; and a number of light-holding charcoal with a plurality of transparent surfaces being disposed on the charcoal bed. The flame curtain with integral structure disposed on the electric fireplace makes an integral combination structure of the image screen and the charcoal bed, which is disposed separately on the traditional electric fireplace. It is a simplification of the structure and assembly of the electric fireplace. A number of light-holding charcoals with a plurality of transparent surfaces are disposed on the charcoal bed, the light-holding charcoal appear to be intermittent light and shade flake light-spot under the irradiation of changeable imaging light of electric fireplace, and thereby the realism of the charcoal bed and the visual effect of the electric fireplace are improved.

Preferably, the flame curtain is a kind of structure of vessel, a front wall and a rear wall of the vessel are transparent, the imaging mechanism is disposed on the front wall of the vessel, a number of movable light-holding charcoals with a plurality of transparent surfaces are disposed in the vessel, the charcoals in the vessel constructs the charcoal bed of the flame curtain. The flame curtain is a kind of structure of vessel, an image mechanism is disposed on the front wall of the vessel, and a number of light-holding charcoals with a plurality of transparent surfaces are disposed in the vessel, such a structure replaces the wood or charcoal bed with integral structure of the conventional electric fireplace. Because of the relative positioning function of the vessel, the light-holding charcoals of various sizes and shapes in the vessel can change the stacking position in the vessel arbitrarily to form a charcoal bed structure of various shapes. Users can customize the figure of the charcoal bed according to personal visual preference to satisfy the visual requirement of every kind of users, at the same time, the visual effect of the electric fireplace is improved. The transparent surface on the light-holding charcoal refers to a certain surface of the light-holding charcoal, which is photic, then refracts and reflects the light passing through, and simultaneously reflects external light, so the light is refracted and reflected inside the light-holding charcoal, among the light-holding charcoal, as well as between the light-holding charcoal and the image screen for several times, and a light-holding effect is achieved. In addition, the shape and size of the light-holding charcoal, the number and transparent property of transparent surfaces can be chosen according to personal preference. A number of translucent surfaces can also be disposed on the light-holding charcoals. Some varying light passes through the light-holding charcoal and is refracted and reflected several times, while some of the varying light is projected directly onto the image screen. Some of the light is reflected several times by the surface of the light-holding charcoals, that is, some light is reflected in the wedge gap. The stacking of plurality of light together with human visual residual effect and the composite effect of visual pictures of human brain result in the light-holding section in the wedge gap around the bright section of the charcoal flame. The light-holding section simulates a continuous rolling and burning flame around the charcoal gap, which improves the realism of the charcoal bed and the visual aesthetic feeling of the electric fireplace. Moreover, the number of light-holding charcoals can be increased or decreased according to personal preference of user, and generally the height of the charcoals is lower than half the height of the front wall of the vessel, in order to reserve enough flame space and charcoal adjusting space for the vessel. The front and rear walls of transparent structure ensure that the imaging light of the electric fireplace passes through the vessel and forms a kind of flame picture on the image screen.

In the other exemplary embodiment, the flame curtain includes a transparent plate, an imaging mechanism and a charcoal bed disposed on the transparent plate, the charcoal bed includes a number of fixed light-holding charcoals with a plurality of transparent surfaces. In the structure described above, a fixed charcoal is adopted in stead of a vessel and a kind of flame curtain with simplified structure is implemented. The charcoal bed can be fixed directly on the transparent plate with the imaging mechanism; an optimized charcoal flame design is fixed on the imaging screen so as to achieve the best visual effect. The charcoal bed is fixed directly on the transparent plate with the imaging mechanism, and the charcoal flame can occur on random location of the imaging screen, which improves the structure of conventional electric fireplace with the characteristics that the charcoal bed of is disposed close to the bottom of the imaging screen so the charcoal flame can only occur flakily at the bottom of the image screen, and a number of independent charcoal flame burning spots can be simulated on one piece of imaging screen, so as to provide various of visual effects.

Preferably, the imaging mechanism is mat surface structure disposed on the front wall of the vessel or the transparent plate, or the imaging mechanism is a thin image screen attached to the front wall of the vessel or the transparent plate, the size of the mat surface structure or the thin image screen matches the size of the front wall of the vessel or the transparent plate respectively. Either the imaging mechanism with mat structure or the thin imaging screen is an exiting technology, for the present invention, if the flame screen is of vessel structure, the thin image screen is preferred and disposed at the inner side of the front wall of the vessel, so a simple and low cost technique is achieved; as to the flame curtain with transparent plate structure, the mat surface structure is preferred, so the imaging mechanism and the transparent plate are of integral structure, the charcoal bed can be fixed directly on the mat surface structure so as to achieve a kind of structure with superior strength.

Preferably, the light-holding charcoal is a polyhedron with numerous refracting surfaces, the polyhedron is made integrally of homogeneous transparent material, a charcoal flame bright section is formed where the light-holding charcoals are close to the imaging mechanism, a wedge gap around the charcoal flame bright section is a light-holding section. The polyhedron light-holding charcoal with numerous refracting surfaces has the functions of refraction and reflection. Under the projection of irregular light from the electric fireplace flame generator, the refraction effect of the light-holding charcoal makes the light of a certain period and a certain angle focus on the imaging screen. Viewing from the image screen, the surface of the light-holding charcoal disposed close to the imaging screen forms a charcoal flame bright section which is similar to the sparkling light-spots of burning charcoal. The light from the flame generator is intermittent, the sparkling light-spots are intermittently bright and shade, which is very similar to the burning and lighting circumstance of real charcoal, and with strong reality. Further more, some light appears like being held in the charcoal bed after several times refraction and reflection by the light-holding charcoal, and a light-holding section is formed in the wedge gap around the charcoal flame bright section which makes people feel like that the flame stays in the gap space of the charcoal, the realism of the charcoal bed and the visual aesthetic feeling of the electric fireplace be farther improved. The light-holding charcoals can also be of a translucent structure. As the transparent effect of the translucent structure is relatively worse, the light transmittance of the charcoal bed is lower, and the brightness of sparkling light-spots and the light-holding section is of lower. However, the simulative charcoal flame of the charcoal bed has a haze feeling and thus another kind of prospect.

Preferably, a plurality of simulative charcoals with natural charcoal shape are disposed on the charcoal bed and the simulative charcoal is of transparent or translucent, a proportion of the simulative charcoals and the light-holding charcoals is from 1:2 to 1:8. By interlarding optimum amount of simulative charcoals with transparent or translucent structure in the light-holding charcoals, the charcoal bed structure is more close to the real charcoal flame. As to the simulative charcoals with transparent and translucent structure, the simulative charcoal with translucent structure is preferred because the relatively weak light transmit capability of the simulative charcoal with translucent structure makes the imaging screen looks darker thereon and some charcoals among the charcoal bed appears to be of burning less intensely. At the same time, the brightness of the outline of simulative charcoals with translucent structure under the projection of the light from the electric fireplace flame generator and the refracting and reflecting light from the light-holding charcoal with polyhedron structure is obviously greater than the brightness of the central portion of charcoals, which accords with the structure characteristics of charcoals at early stage of burning, and thus the simulation effect of the charcoal is obviously enhanced.

Preferably, the front wall, the rear wall of the vessel are of flat or curved surface structure, the width and height of the rear wall of the vessel are the same as the front wall of the vessel. As the front wall of the vessel or the transparent plate also works as the imaging screen of the electric fireplace, the front wall of the vessel or the transparent plate with flat or curved structure conforms to general requirements of the electric fireplace imaging screen structure. For the flame curtain with vessel structure, the rear wall structure of the vessel is preferred to be of the same structure with that of the front wall. Thereby, the whole vessel is of a kind of structure with constant thickness, which avoids the regional brightness variation of the imaging screen brought by the variation of the thickness of vessel. If such variation is considered on the design process, a vessel structure with thinner central portion and both thick side portions could be taken into account to conform to structure characteristics of normal burning substance with higher luminance at the center portion of burning and lower luminance at the side portion. Moreover, the height of the rear wall of the vessel is preferred to be of the same as that of the front wall. Though the height of the light-holding charcoals disposed in the vessel usually does not approach to the top of the front wall of the vessel. If the height of the rear wall is decreased for the saving of material, the upper edge of the rear wall of the vessel may appear on the imaging screen under the projection of light from the flame generator and thus influences the realism of the flame simulation of the electric fireplace and the visual effect. Irregular edges at upper end of the rear wall of the vessel can compensate this shortcoming described above at a certain extent. As the vessel has a certain thickness, when a user sights from above to below, the charcoal flame should be observed at the bottom of the vessel. Thus, the bottom plate of the vessel is preferred to be transparent or translucent. By the projection of the imaging light source at the bottom of the fireplace, the charcoal at the bottom of the vessel appears to be of bright structure according to the structure characteristic of real charcoal flame. For the flame curtain of transparent plate structure, the charcoal bed is generally disposed at the lower portion the transparent plate for reserving a certain space for the flame occurring above the charcoal bed. Customarily, more than half of space could be reserved as a simulative space of the burning flame.

As a metamorphic exemplary embodiment of the flame curtain with vessel structure, the bottom of the front wall of the vessel is protrusive to form a concave groove inside, the concave groove has a trapezoid cross-section. By fulfilling the concave groove of the vessel with charcoals, the bottom structure of the charcoal flame is improved to be more three-dimensional, so is the felling of the charcoal flame. The concave groove with trapezoid cross-section makes the transition of upper and lower charcoal flame more nature and close to the nature configuration of real charcoal flame.

As a metamorphic exemplary embodiment of the flame curtain with transparent plate structure, a lower end of the transparent plate bends forward to be L-shaped portion, the charcoal bed has a L-shaped portion corresponding to the L-shaped portion of the transparent plate and is attached thereon. A charcoal bed with inclined structure is formed on the electric fireplace, which enhances the bottom structure and the three-dimensional characteristic of the charcoal flame structure, and gets close to its nature configuration. The bending structure could be disposed at the lower end of both the flat and the curved surface structure of the transparent plate.

Preferably, a bottom flame generator is disposed at the bottom portion of the vessel, the bottom flame generator includes a rotating axis driven by electric machinery and reflecting strips disposed on the rotating axis, or being of axis sleeve type including central axis, rotating sleeve and reflecting strips disposed on the rotating sleeve. Both the concave groove disposed at the bottom of the vessel and the bend portion of transparent plate are basically transverse, light from the back of the vessel or the transparent plate is difficult to form an well simulative image on the inclined bottom image screen. Thus, a bottom flame generator is particularly disposed at the bottom portion of the bend portion of the transparent plate or the vessel, hereby the imaging light simulating the sparkling light-spot of the charcoal flame appears on the imaging mechanism at the bottom of the front wall of the vessel or the bending section of the transparent plate, the realism of the charcoal flame is increased.

The essential effect of the present invention is to solve the problems of constant charcoal flame brightness, the lacking of reality and the bad charcoal flame simulation effect in conventional electric fireplaces. Meanwhile, the problems of constant charcoal flame shape, dull appearance and poor visual effect in conventional electric fireplace are solved as well. The present invention is of simple structure and easy assembly process, while the charcoal flame structure can be arbitrarily changed, the light-spots of the flame are sparkling intermittently with bright and shade, and the flame is of light-holding effect. The visual effect and the authenticity are both perfect.

DETAILED DESCRIPTION OF THE INVENTION

Through the embodiments described subsequently and the drawings combined with, the technique detailed of the present invention could be fully understood.

Preferred Embodiment 1

Figure 1:
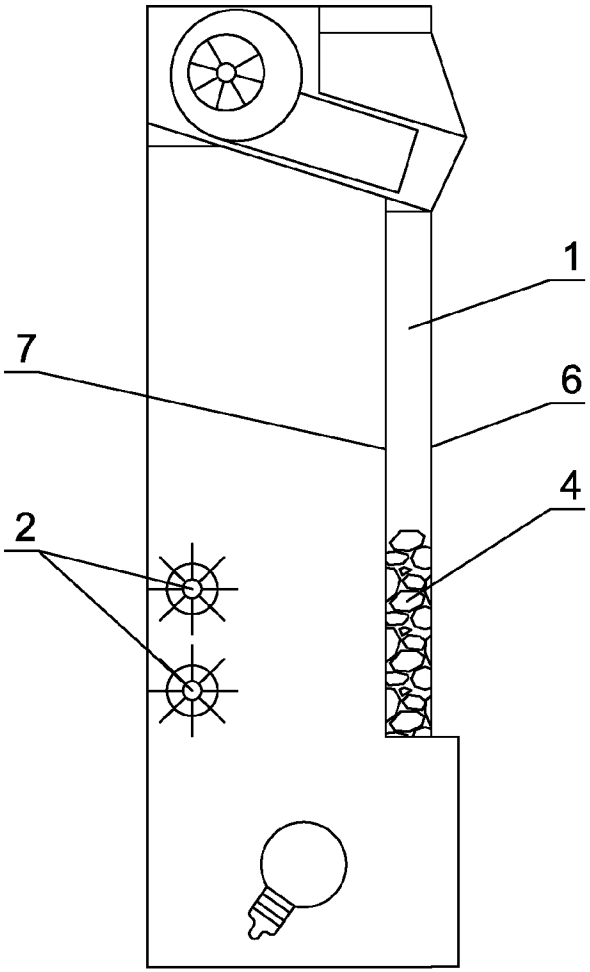
FIG. 1 shows the first embodiment of the electric fireplace with a flame curtain according to the present invention.
Figure 5:
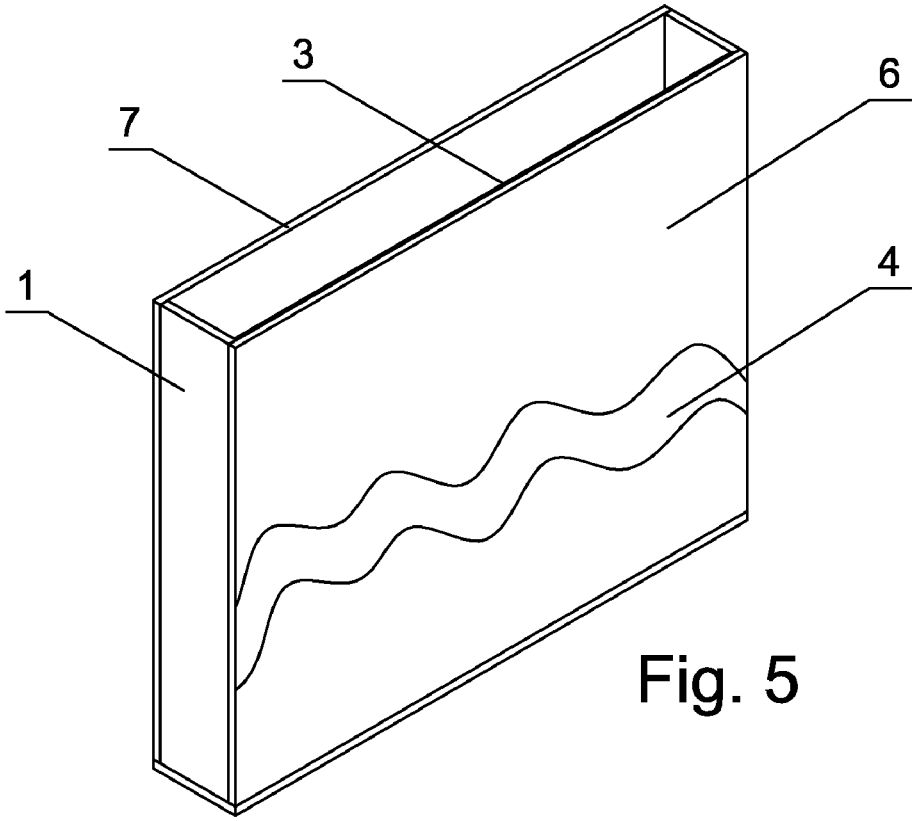
FIG. 5 shows the flame curtain structure according to the first embodiment of the present invention.
Figure 9:
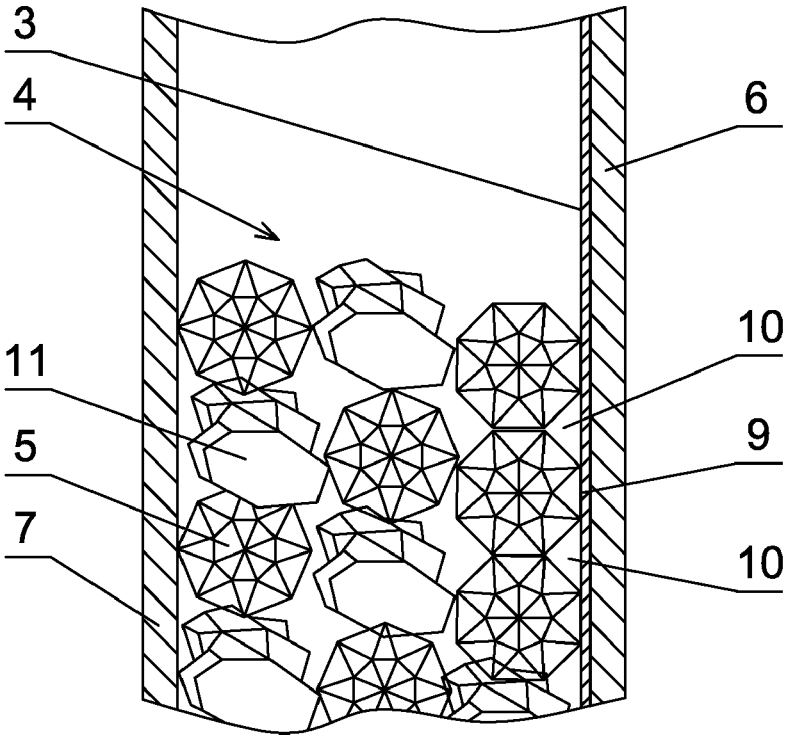
FIG. 9 shows a partial view of the flame curtain structure according to the first embodiment of the present invention.

As shown in FIG. 1, an electric fireplace with a flame curtain comprises a housing, a light source, a flame curtain 1 with integral structure being disposed on the electric fireplace (as shown in FIG. 5 and FIG. 9) and in front of an electric fireplace flame generator 2, the flame generator includes a rotating axis driven by electric machinery and reflecting strips disposed on the rotating axis, the flame curtain 1 is a kind of structure of vessel, a front wall 6 he a rear wall 7 of the vessel are transparent and the size of the rear wear 7 are the same as the front wall 6, the imaging mechanism 3 is disposed on the front wall 6 of vessel, and the imaging mechanism 3 is a mat surface structure disposed on the front wall 6 of the vessel, the size of the mat surface structure matches the size of the front wall 6 of the vessel.

A number of moveable light-holding charcoals 5 with a plurality of transparent surfaces and a plurality of simulative charcoals 11 with natural charcoal shape are disposed in the vessel, a proportion of the simulative charcoals 11 and the light-holding charcoals 5 is 1:2. The light-holding charcoals 5 is a polyhedron with numerous refracting surfaces, the polyhedron is made integrally of homogeneous transparent material, a charcoal flame bright section 9 is formed where the light-holding charcoals 5 are close to the imaging mechanism, a wedge gap around the charcoal flame bright section is a light-holding section 10. The charcoals in the vessel construct the charcoal bed of the flame curtain 1.

Preferred Embodiment 2

Figure 2:
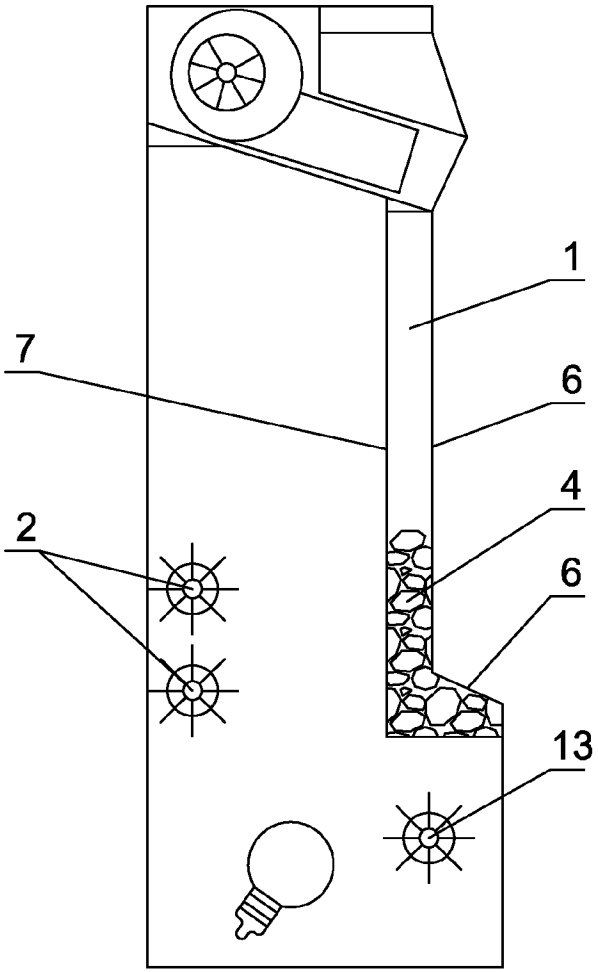
FIG. 2 shows the second embodiment of the electric fireplace with a flame curtain according to the present invention.
Figure 6:
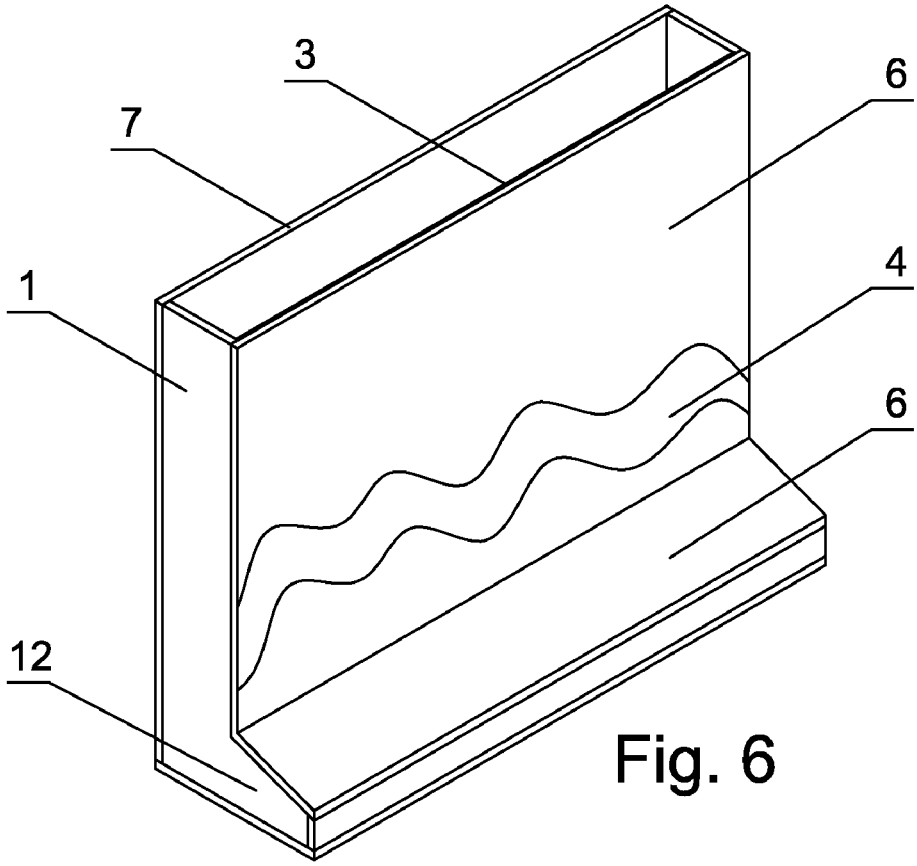
FIG. 6 shows the flame curtain structure according to the second embodiment of the present invention.

As shown in FIG. 2, the bottom of the front wall 6 of the vessel is protrusive to form a concave groove 12 inside, the concave groove 12 has a trapezoid cross-section (as shown in FIG. 6). A number of moveable light-holding charcoals 5 with a plurality of transparent surfaces and a plurality of simulative charcoals 11 with natural charcoal shape are disposed in the vessel. A proportion of the simulative charcoals 11 and the light-holding charcoals 5 is 1:4. The imaging mechanism 3 is a thin image screen attached to the front wall 6 of the vessel, the size of the thin image screen matches the size of the front wall 6 of the vessel. A bottom flame generator 13 is disposed at the bottom portion of the vessel. The bottom flame generator 13 includes a rotating axis driven by electric machinery and reflecting strips disposed on the rotating axis. The other structures are the same as that in the first preferred embodiment.

Preferred Embodiment 3

Figure 3:
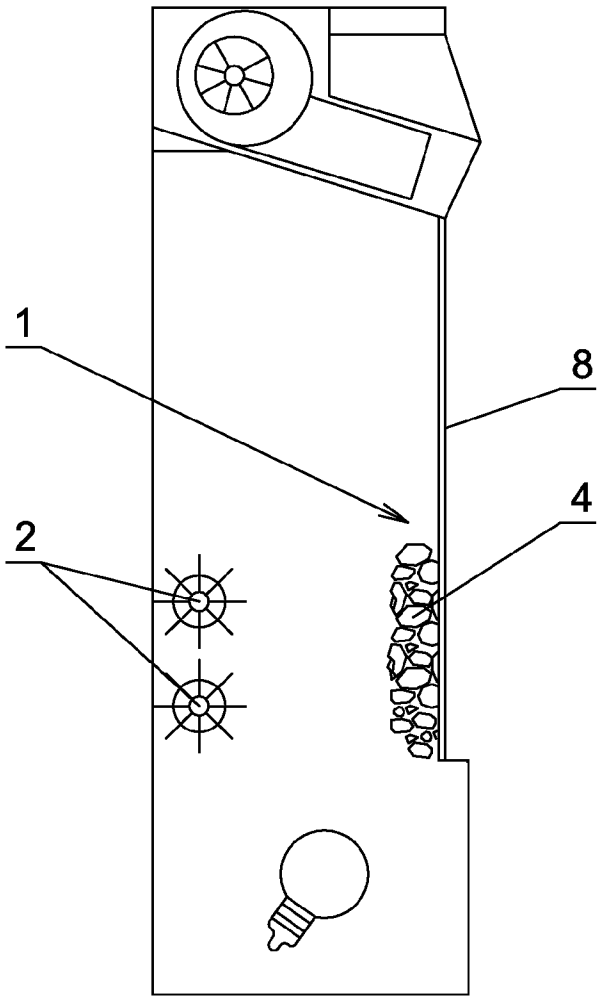
FIG. 3 shows the third embodiment of the electric fireplace with a flame curtain according to the present invention.
Figure 7:
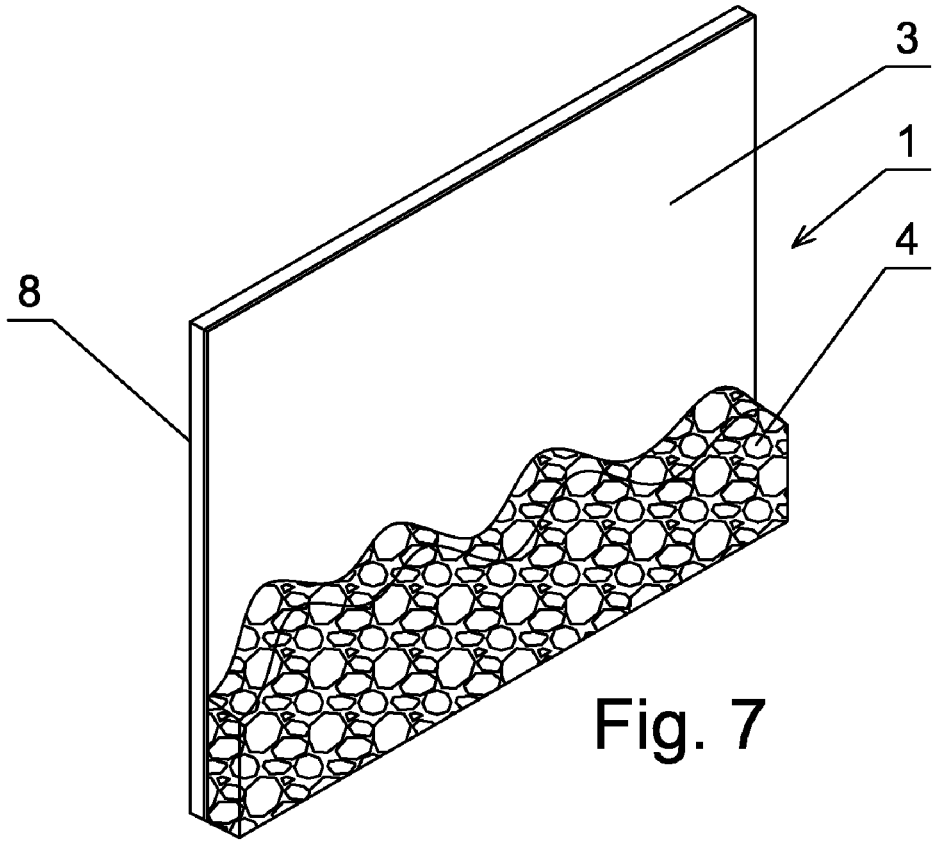
FIG. 7 shows the flame curtain structure according to the third embodiment of the present invention.
Figure 10:
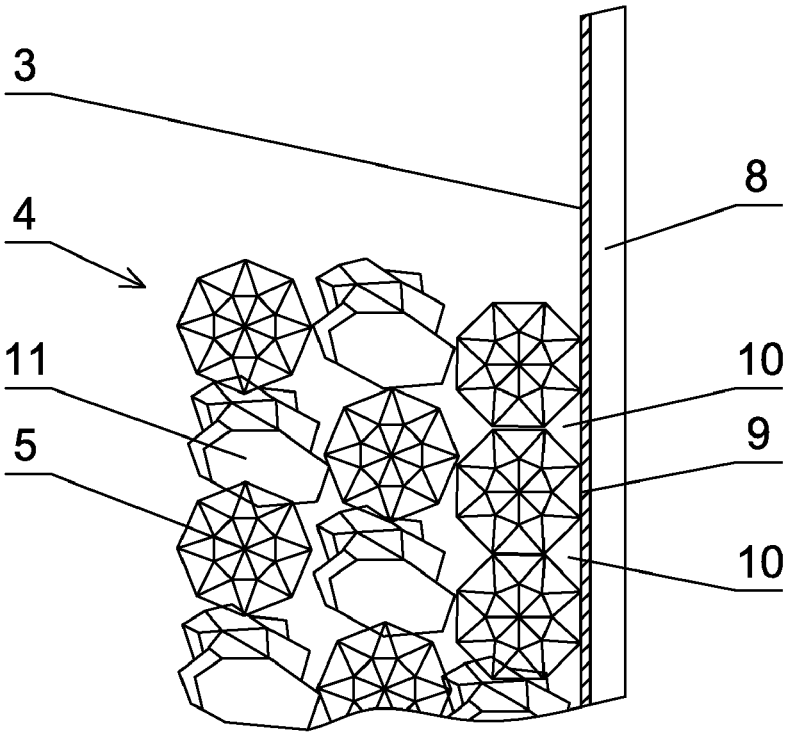
FIG. 10 is shows a partial view of the flame curtain structure according to the third embodiment of the present invention.

As shown in FIG. 3, an electric fireplace with a flame curtain comprises a housing, a light source, a flame curtain 1 with integral structure being disposed on the electric fireplace (as shown in FIG. 7 and FIG. 10), the flame curtain 1 includes a transparent plate 8 and a charcoal bed 4 disposed on the transparent plate 8. The flame curtain 1 is disposed in the front of an electric fireplace flame generator 2, the flame generator 2 includes a rotating axis driven by electric machinery and reflecting strips disposed on the rotating axis. The transparent plate is a grass flat plate with a mat structure disposed on the side near to flame generator, the size of the mat structure matches the size of the transparent plate. The charcoal bed 4 is disposed on the mat structure. The charcoal bed 4 includes a number of light-holding charcoals 5 with a plurality of transparent surfaces and a plurality of simulative charcoals 11 with natural charcoal shape. A proportion of the simulative charcoals 11 and the light-holding charcoals 5 is 1:6. The light-holding charcoal 5 is a polyhedron with numerous refracting surfaces. The polyhedron is made integrally of homogeneous transparent material. A charcoal flame bright section 9 is formed where the light-holding charcoals 5 are close to the imaging mechanism. The charcoals disposed on the transparent plate construct the charcoal bed of the flame curtain 1.

Preferred Embodiment 4

Figure 4:
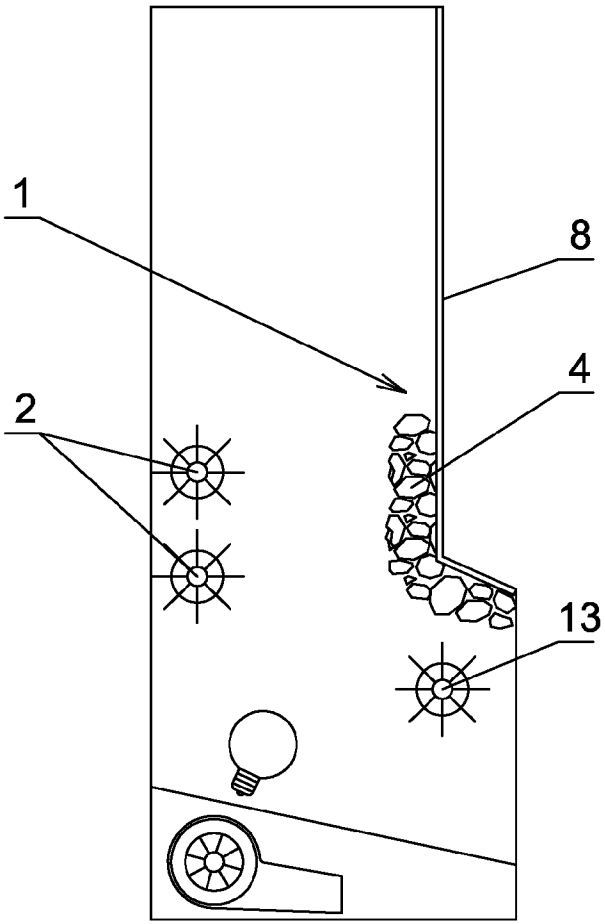
FIG. 4 shows the forth embodiment of the electric fireplace with a flame curtain according to the present invention.
Figure 8:
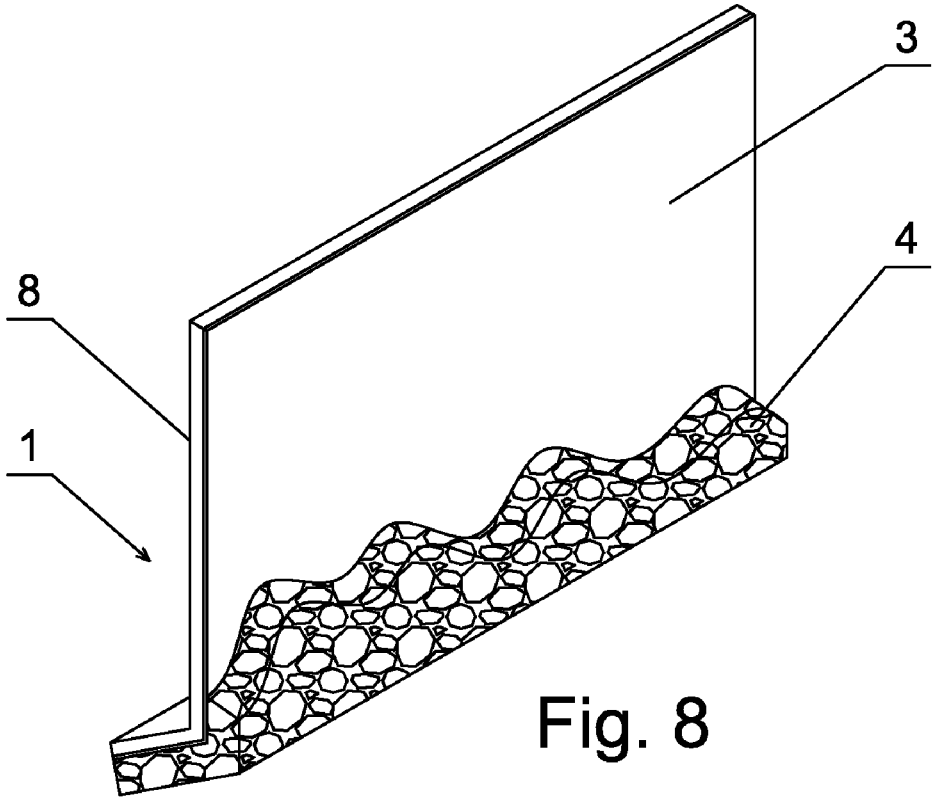
FIG. 8 shows the flame curtain structure according to the forth embodiment of the present invention.

As shown in FIG. 4, the lower end of the transparent plate 8 bends forward to be L-shaped structure portion. The charcoal bed 4 has a L-shaped portion corresponding to the L-shaped portion of the transparent plate 8 and is attached thereon (as shown in FIG. 8). The imaging mechanism 3 is a thin image screen attached to the vessel or the transparent plate 8 and the thin image screen is fixed on the transparent plate, the size of the thin image screen matches the size of the transparent plate 8, the charcoal bed 4 has a L-shaped portion corresponding to the L-shaped portion of the transparent plate 8 and is attached thereon. A plurality of simulative charcoals 11 with natural charcoal shape are disposed on the charcoal bed, the simulative charcoal 11 is translucent. A proportion of the simulative charcoals and the light-holding charcoals is 1:8. A bottom flame generator 13 is disposed below the bending section of the transparent plate 8. The bottom flame generator 13 includes a rotating axis driven by electric machinery and reflecting strips disposed on the rotating axis. The other structures are the same as that in the third preferred embodiment.

When the electric fireplace with a flame curtain is in use, the flame curtain is disposed in front of the electric fireplace flame generator. The light source of the electric fireplace is reflected to the flame curtain through the flame generator. Image shown at the higher portion of the flame curtain without charcoals disposed beside is basically the same as imaging effect produces by conventional technique. Flame image of burning wood is formed under the projection of the jumping imaging light. When the light is project to the light-holding charcoals at the lower portion of the flame curtain, light at a certain period and with a certain angle focuses on the image screen. Viewing on the image screen, a charcoal bright section is formed where the light-holding charcoals are close to the imaging mechanism, the charcoal bright section is very familiar to sparkling light-sports of burning charcoals, and it is perfectly living. Because the light from the flame generator is intermittent, the sparkling light-spots are intermittently bright and shade, which is very similar to burning and lighting circumstance of real charcoal. Besides, some light feels like being held in the charcoal bed after numbers of refraction and reflection by the light-holding charcoal, and a light-holding section is formed in the wedge gap around the charcoal flame bright section which makes people feel like that the flame stays in the gap space of the charcoals, further improves the reality of the charcoal bed and the visual aesthetic feeling of the electric fireplace. As to the simulative charcoals with translucent structure disposed on the charcoal bed, they are less pervious to light and thus look darker on the image screen, and thereby some charcoals with less burning level appear in the charcoal bed. Under the projection of the light from the electric fireplace flame generator and the refracting and reflecting light from the light-holding charcoals with polyhedron structure, the brightness at the outline of the charcoal is greater than the brightness at the center of the charcoal. Such structure conforms to the structure characteristics when charcoals start burning, and thus the simulation effect of the charcoal is obviously improved.

As to the structure of the concave groove disposed at the bottom of the flame curtain and the bend structure of the transparent plate, the projecting light to the concave groove or the bend structure mainly depends on the bottom flame generator disposed at the bottom portion of the flame curtain or below the bending section of the transparent plate. The flame effect is quite the same as the main embodiment, but, they bottom structure of the charcoal flame is improved, the flame structure is more three-dimensional, and the three-dimensional feeling of the charcoal flame is improved a lot. The transition of charcoals disposed upper and lower is nature and feels like the nature configuration of charcoal flame.

As to the electric fireplace with the vessel structure flame curtain, when the shape of charcoal bed needs to be change, the only thing one need to do is to open the cover plate of the electric fireplace and stir, add or remove the charcoals disposed in, or change the proportion of various charcoals to reshape the shape of the charcoal bed. Not only the shapes of charcoals bed is changed, the light path of refraction and reflection inside the charcoal bed the flame bright section and the light-holding section also changes. Therefore, a brand new appearance presents leads to a completely different visual effect.

What is claimed is:

1. An electric fireplace with a flame curtain comprising:

a housing;

a light source;

a flame curtain (1) with integral structure, which is disposed on the electric fireplace and in front of an electric fireplace flame generator (2);

an imaging mechanism (3) and a charcoal bed (4) disposed on the flame curtain (1);

the charcoal bed (4) is composed of a number of light-holding charcoals (5) and simulative charcoals (11);

each one of the light-holding charcoals is a transparent polyhedron with numerous refracting surfaces, each one of the simulative charcoals is of transparent or translucent with a natural charcoal shape;

a proportion of the simulative charcoals (11) and the light-holding charcoals (5) is from 1:2 to 1:8.

2. The electric fireplace with a flame curtain as claimed in claim 1, wherein the flame curtain (1) is a structure of vessel, a front wall (6) and a rear wall (7) of the vessel are transparent, the imaging mechanism (3) is disposed on the front wall (6) of the vessel, the number of light-holding charcoals (5) and simulative charcoals (11) are disposed in the vessel to form the charcoal bed of the flame curtain (1).

3. The electric fireplace with a flame curtain as claimed in claim 2, wherein the imaging mechanism (3) is a mat surface structure disposed on the front wall (6) of the vessel, or the imaging mechanism (3) is a thin image screen attached to the front wall (6) of the vessel, the size of the mat surface structure or the thin image screen matches the size of the front wall (6) of the vessel.

4. The electric fireplace with a flame curtain as claimed in claim 3, wherein the front wall (6), rear wall (7) of the vessel are of flat or curved surface structure, the width and height of the rear wall (7) of the vessel are the same as the front wall (6) of the vessel.

5. The electric fireplace with a flame curtain as claimed in claim 2, wherein the front wall (6), the rear wall (7) of the vessel are of flat or curved surface structure, the width and height of the rear wall (7) of the vessel are the same as the front wall (6) of the vessel.

6. The electric fireplace with a flame curtain as claimed in claim 2, wherein a bottom of the front wall (6) of the vessel is protrusive to form a concave groove (12) inside, the concave groove (12) has a trapezoid cross-section.

7. The electric fireplace with a flame curtain as claimed in claim 6, wherein a bottom flame generator (13) is disposed at the bottom portion of the vessel, the bottom flame generator (13) includes a rotating axis driven by electric machinery and reflecting strips disposed on the rotating axis, or the bottom flame generator (13) includes a central axis, rotating sleeve and reflecting strips disposed on the rotating sleeve.

8. The electric fireplace with a flame curtain as claimed in claim 1, wherein the imaging mechanism (3) is a mat surface structure disposed on a front wall (6) of a vessel or a transparent plate (8), or the imaging mechanism (3) is a thin image screen attached to the front wall (6) of the vessel or the transparent plate (8), the size of the mat surface structure or the thin image screen matches the size of the front wall (6) of the vessel or the transparent plate (8) respectively.

9. The electric fireplace with a flame curtain as claimed in claim 8, wherein the front wall (6), rear wall (7) of the vessel and the transparent plate (8) are of flat or curved surface structure, the wide and high of the rear wall (7) of the vessel are the same as the front wall (6) of the vessel.

10. The electric fireplace with a flame curtain as claimed in claim 1, wherein the light-holding charcoal (5) is made integrally of homogeneous transparent material, a charcoal flame bright section (9) is formed where the light-holding charcoals (5) are close to the imaging mechanism, a wedge gap around the charcoal flame bright section is a light-holding section (10).

* * * * *